United States Patent [19]

Grecksch et al.

[11] Patent Number: 4,664,326

[45] Date of Patent: May 12, 1987

[54] AUTOMATIC WINDING MACHINE

[75] Inventors: Hans Grecksch, Monchen-Gladbach; Leo Tholen, Heinsberg, both of Fed. Rep. of Germany

[73] Assignee: W. Schlafhorst & Co., Monchen-Gladbach, Fed. Rep. of Germany

[21] Appl. No.: 855,752

[22] Filed: Apr. 24, 1986

[30] Foreign Application Priority Data

Apr. 25, 1985 [DE] Fed. Rep. of Germany ..... 3514935

[51] Int. Cl.[4] ..... B65H 54/02; B65H 67/06

[52] U.S. Cl. ..... 242/35.5 A; 242/35.5 R; 242/35.6 R

[58] Field of Search ..... 242/35.5 A, 35.5 R, 242/35.6 R

[56] References Cited

U.S. PATENT DOCUMENTS

| | | | |
|---|---|---|---|
| 2,350,927 | 6/1944 | Reiners et al. | 242/35.5 A |
| 3,480,215 | 11/1969 | Matsui et al. | 242/35.5 R |
| 3,933,320 | 1/1976 | Tsurumi et al. | 242/35.5 R |
| 3,951,350 | 4/1976 | Uchida | 242/35.5 A |
| 3,966,141 | 6/1976 | Nishiyama et al. | 242/35.5 A |
| 3,998,397 | 12/1976 | Haberkorn et al. | 242/35.5 A |
| 4,010,907 | 3/1977 | Nishiyama et al. | 242/35.5 A |
| 4,339,090 | 7/1982 | Matsui et al. | 242/35.5 A |
| 4,558,829 | 12/1985 | Aretz et al. | 242/35.5 A |
| 4,576,340 | 3/1986 | Aretz et al. | 242/35.5 A |
| 4,589,602 | 5/1986 | Reiners et al. | 242/35.5 R |

*Primary Examiner*—Stanley N. Gilreath

*Attorney, Agent, or Firm*—Herbert L. Lerner; Laurence A. Greenberg

[57] ABSTRACT

An automatic winding machine includes: a multiplicity of winding stations; a conveyor belt guided along the winding stations for supplying individual spools in axial alignment to the winding stations in a given transport direction along a given transport plane; each of the winding stations including: a run-off position and a reserve position in which respective spools are maintained in readiness, a controllable deflector for conducting spools base-first from the conveyor belt to the reserve position, a chute for guiding spools from the reserve position to the run-off position, a spool receiving trough disposed below the given transport plane and substantially parallel to the given transport direction, a controllable thread suction device, and means for shifting the spool receiving trough from a relatively flat position to a relatively upright position in which a tip of a tube of a spool in the spool receiving trough approaches the thread suction device and the spool is aligned in the chute.

7 Claims, 3 Drawing Figures

AUTOMATIC WINDING MACHINE

The invention relates to an automatic winding machine, including a multiplicity of winding stations each having a spool available in a run-off position and an additional spool in a reserve position, devices for supplying the winding stations with reserve spools by means of a conveyor belt on which the spools are individually transported in axial alignment in a transport direction, and a controllable deflector for conducting the spools away from the conveyor belt into the reserve position.

In automatic machines for winding cross-wound bobbins with automatic spool supplying devices, the spools are supplied to the individual winding stations with the aid of a transport device which is guided alongside the automatic winding machine. A central automatic spool preparation station disposed at the front of the transport device searches for the thread end of the spool, and sucks it into the tube or sleeve of the spool. Upon receiving a request from the individual winding stations, the spools are discharged from the spool preparation station in sequence.

In conventional automatic winding machines, spools which have been prepared by sucking the thread end into the tube or sleeve, are deposited with axial alignment onto a flat conveyor belt which leads to the individual winding stations where the spools are discharged by a controllable deflector. This discharge is carried out from a flat position of the spools into round magazines, which contain several storage pockets in which the spools are stored in an upright position. A disadvantage of this device is that the spools, which are only moved by friction on the conveyor belt, must be deflected through approximately 90° by suitable guide contours along with the force of gravity, in order to reach the round magazine in an upright position.

Consequently, the transfer of the spools is frequently delayed and malfunctions and back-up accumulations of spools sometimes occur.

An additional disadvantage is the relatively great width of the machine, which is a necessary consequence of using round magazines. The magazine can sometimes also be loaded by hand, but the relatively great storage capacity thereof is still not fully utilized for various reasons.

It is accordingly an object of the invention to provide an automatic winding machine which overcomes the hereinafore-mentioned disadvantages of the heretofore-known devices of this general type, and to reduce the width of the machine while still providing a reserve of spools at each winding station, in order to guarantee a rapid, smooth supply or flow of spools without disturbances.

With the foregoing and other objects in view there is provided, in accordance with the invention, an automatic winding machine, comprising: a multiplicity of winding stations; a conveyor belt guided along the winding stations for supplying individual spools in axial alignment to the winding stations in a given transport direction along a given transport plane; each of the winding stations including: a run-off position and a reserve position in which respective spools are maintained in readiness, a controllable deflector for conducting spools base-first from the conveyor belt to the reserve position, a chute for guiding spools from the reserve position to the run-off position, a spool receiving trough disposed below the given transport plane and substantially parallel to the given transport direction, a controllable thread suction device, and means for shifting the spool receiving trough from a relatively flat position to a relatively upright position in which a tip of a tube of a spool in the spool receiving trough approaches the thread suction device and the spool is aligned on the chute.

According to the invention, the mass of the moving parts is reduced to a minimum, so that only the mass of the individual spools is of importance. Consequently, all motions and shifting operations can be performed rapidly and securely.

In accordance with another feature of the invention, there is provided a controllable spool releasing device disposed between the spool receiving trough and the chute.

In accordance with a further feature of the invention, the spool receiving trough includes a sensor sensing the presence of a spool, the sensor issuing a spool request signal and a spool receipt signal.

In accordance with an added feeature of the invention, the sensor controls the deflector.

In accordance with an additional feature of the invention, the spool receiving trough has side walls and the sensor is a reflecting light gate disposed in the side walls.

In accordance with again another feature of the invention, there is provided an upright stationary sheet metal trough serving as a stop for a base of the spool when the spool receiving trough is in the relatively flat position, and forming a sleeve with the spool receiving trough preventing tipping of the spool when the spool receiving trough is in the relatively upright position.

In accordance with a concomitant feature of the invention, the spool receiving trough has an edge, and including a sheet metal guide extending at an incline relative to the horizontal from the conveyor belt to the edge, the sheet metal guide including a trough-shaped part forming an elongation of the spool receiving trough when the spool receiving trough is in the relatively upright position.

Other features which are considered as characteristic for the invention are set forth in the appended claims.

Although the invention is illustrated and described herein as embodied in an automatic winding machine, it is nevertheless not intended to be limited to the details shown, since various modifications and structural changes may be made therein without departing from the spirit of the invention and within the scope and range of equivalents of the claim.

The construction and method of operation of the invention, however, together with additional objects and advantages thereof will be best understood from the following description of specific embodiments when read in connection with the accompanying drawings, in which.

Figure 1:
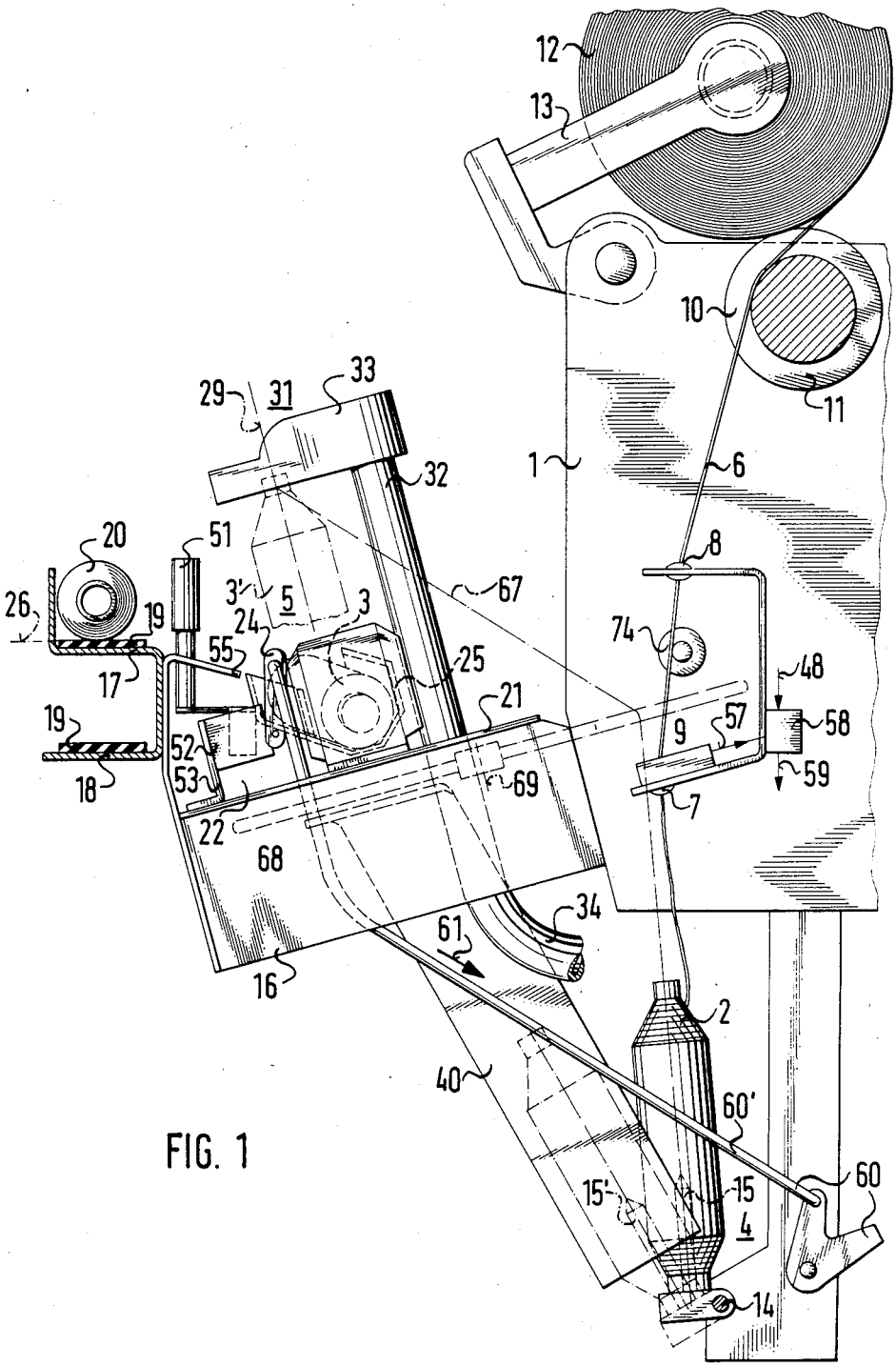
FIG. 1 is a fragmentary, diagrammatic, side-elevational view of a winding station according to the invention.

Referring now to the figures of the drawings in detail, there is seen an automatic winding machine, which is not shown with all of its details, but which includes numerous winding stations 1, each having one cop or spool 2 available in a run-off position 4 and another cop or spool 3 in a reserve position 5.

A thread 6, which runs off from the spool 2, is conducted through thread eyes 7, 8, past a sensor 9 which senses the presence of a lower thread, and through a reverse thread groove 10 of a thread guiding roller 11 to a cross-wound bobbin or cheese 12. The cross-wound bobbin 12 is supported in a bobbin frame 13, lies on the thread guiding roller 11 and is driven by the roller 11.

According to FIG. 1, the run-off position 4 contains a movable mounting pin 15 for the spool 2, which can pivot about an axis 14, from the illustrated position of the pin in the run-off position 4 to a loading position 15' shown in phantom in the drawing.

The winding station 1, as well as all of the other winding stations, is equipped with devices for providing the winding station with reserve spools 3.

One of these devices is a bracket 16 which is provided at each winding station 1 and carries, among other items, sheet metal slides 17, 18 of a conveyor belt or transport band 19. The upper run of the conveyor belt carries spools or cops 20 having axes aligned in the transport direction. The spools 20 come from a non-illustrated cop or spool preparation station.

The bracket 16 carries a flat plate 21 on which a support block 22 is fastened. According to FIG. 3, the support block 22 carries a shaft 23, which is connected at its forward end with a shifting lever 24 and at its back end with a spool receiving trough 25.

According to FIG. 1, the spool receiving trough 25 is disposed below the transport plane 26 of the conveyor belt 19, and according to FIG. 2 it is approximately parallel to the transport direction 27 of the conveyor belt 19.

Figure 3:
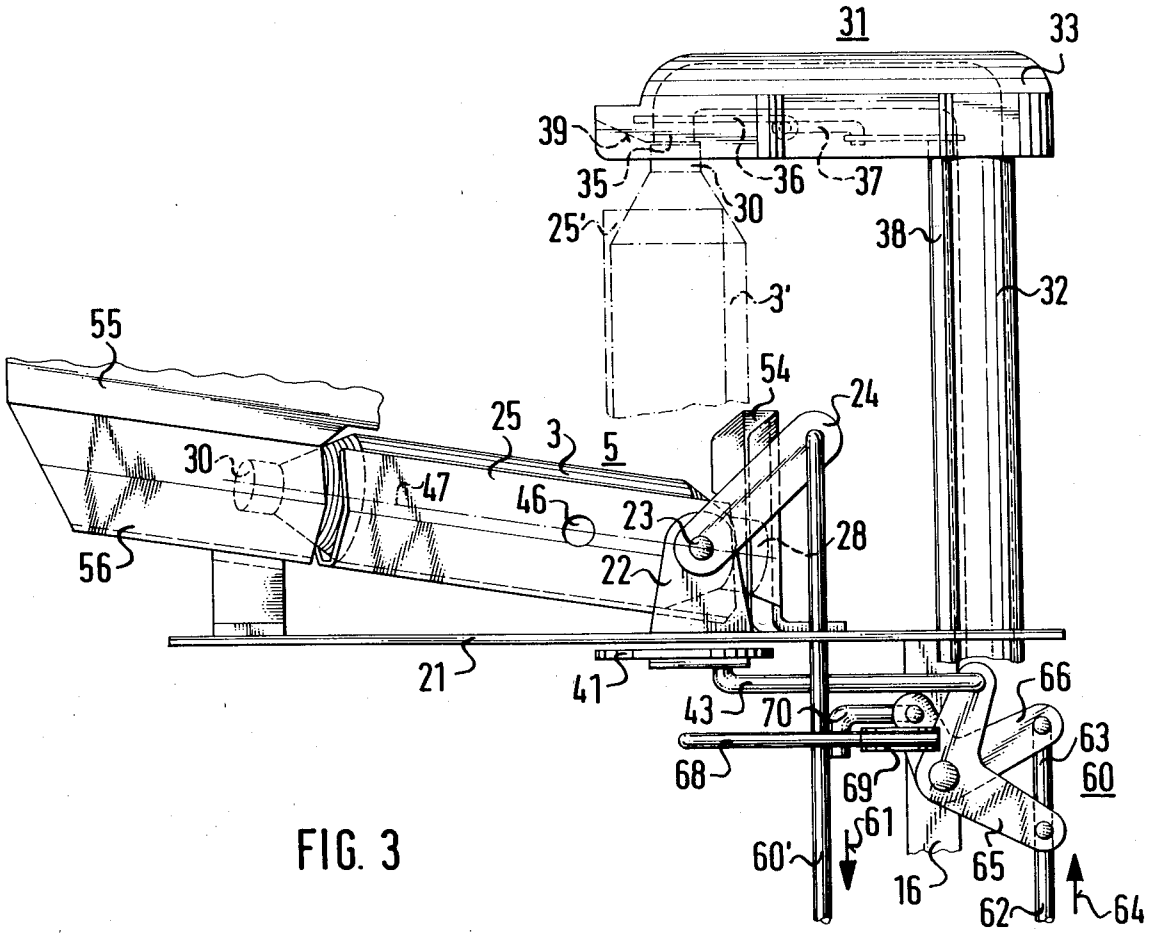
FIG. 3 is a fragmentary, front-elevational view of the winding station shown in FIG. 1, without the conveyor belt.

With the aid of the shifting lever 24, the spool receiving trough 25 can be shifted from the flat or lowered position shown in FIG. 3 to an upright or raised position 25' shown in phantom in same FIG. 3. In the illustrated embodiment, the spool receiving trough 25, while in the flat positin, is inclined at an angle of about 10° relative to the horizontal, beginning at the foot 28 of the sleeve or tube of a spool 3 which has been accepted. In the upright position, the spool receiving trough 25 has approached the vertical position within about 15°, as indicated by the center line 29 in FIG. 1.

FIG. 3 shows especially clearly that by shifting the spool receiving trough 25 from the flat position to the upright position, the point 30 of the tube or sleeve can be moved into the close vicinity of a controllable thread suction device 31.

The thread suction device 31 is formed of a longitudinally adjustable tube 32, which has a suction head 33 at is upper end and a flexible suction line 34 at its lower end which can be connected to a non-illustrated suction source, at least from time to time. The mouth or orifice 35 of the suction head is directed toward the point 30 of the tube or sleeve, if the spool 3 shown in FIG. 3 is in the upright position 3'.

The thread suction device 31 can be controlled in such a manner that a slider 36, which simultaneously acts as a thread clamp, can close the suction head orifice 35, and thereby clamp a sucked-in thread. The slider 36 can be controlled by a lever configuration 37 which is in turn controlled by means of a rotatable rod 38.

In the upright position, the spool receiving trough 25 and therefore the spool 3 which is in the position 3', is aligned with a chute 40, which extends from the reserve position 5 to the runoff position 4, as shown especially in FIG. 1.

A controllable releasing device 41 is disposed between the spool receiving trough 25 and the chute 40, as especiialy shown in FIG. 3. The spool releasing device 41 is constructed in the form of a slider which, according to FIG. 2, articulates about a point 42 and can be swung to the side by a lever configuration 43.

Figure 2:
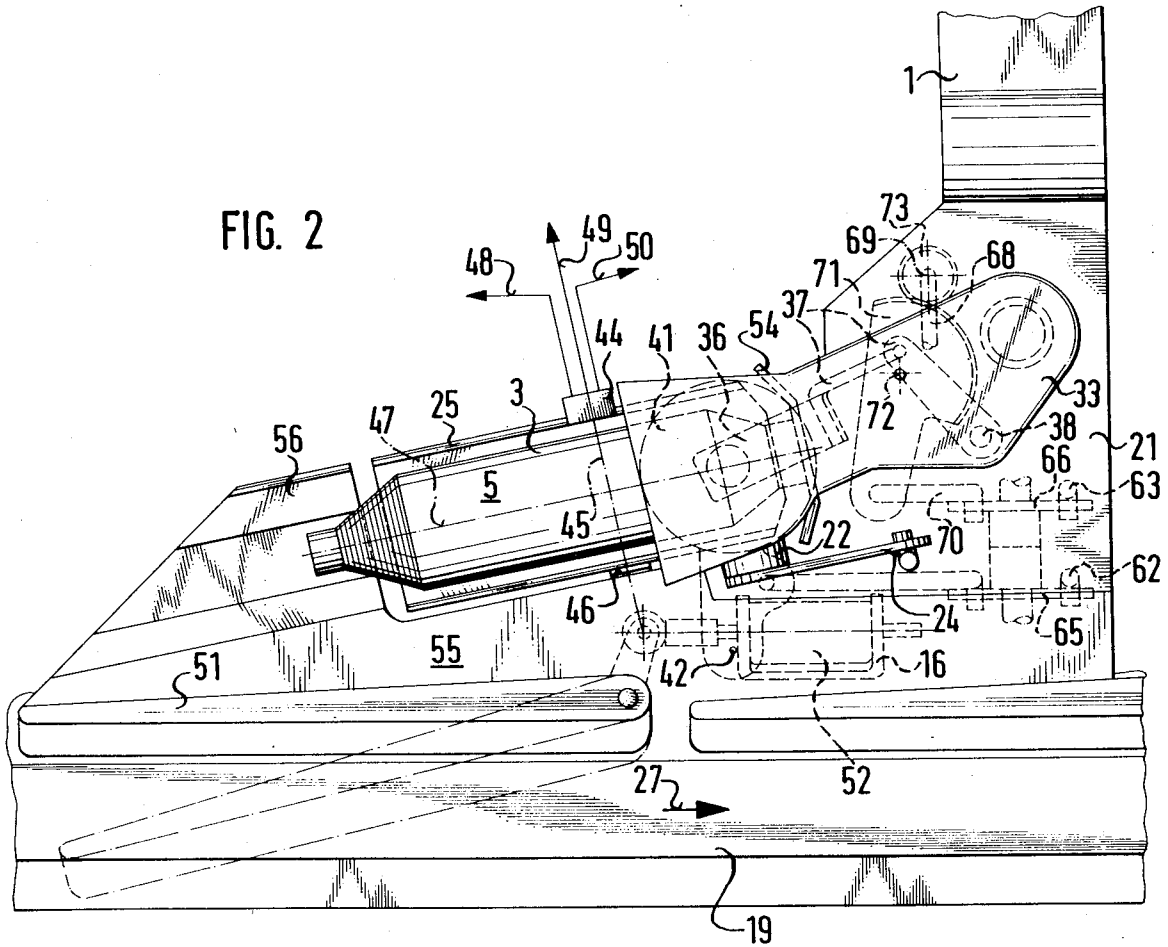
FIG. 2 is a fragmentary top-plan view of the winding station of FIG. 1.

According to FIG. 2, the spool receiving trough 25 is provided with a sensor 44, which senses the presence of a spool. The spool presence sensor 44 is formed of a reflecting light barrier or gate, which is disposed in the side wall of the spool receiving trough 25 and has a mirror which lies in the optical axis 45 thereof. If a spool lies in the spool receiving trough 25, the optical axis 45 of the reflecting light gate 44 passes approximately through the central axis 47 of the spool 3.

If the spool presence sensor 44 senses the presence of a spool 3 in the spool receiving trough 25, it gives off a signal through a functional or operational connection 48, signalling that a spool has been received, and if so desired, this signal may be used to close a deflector 51, which is disposed alongside the conveyor belt 19. The closing and opening of the deflector 51 is effected by an electromagnetic drive 52, which is connected with the plate 21 by means of a bracket 53.

If the spool presence sensor 44 senses the absence of a spool, such as after the spool has been brought into the run-off position by opening the spool releasing device 41 through the chute 40, the sensor sends a spool request signal to the above-mentioned spool preparation station over an additional functional or operative connection 49, in some cases with a predetermined delay time. At the same time, if so desired, a signal for opening the deflector 51 can be sent to the electro-magnetic drive 52 over an additional functional or operative connection 50, in some cases after a predetermined time delay as well.

The above-mentioned time delays serve the purpose of requesting a spool or opening the deflector, no sooner than the time at which the spool receiving trough 25 reaches the flat position again.

According to a non-illustrated alternate embodiment, the spool presence sensor 44 is stationary, and faces the mirror 46 through a hole in the side wall of the spool receiving trough 25. In this case, an adjustable time delay is not required, because the spool receiving trough 25 is already in the flat position, if the optical axis 45 is to intersect the mirror 46, as shown in FIG. 2.

According to FIGS. 2 and 3, the spool receiving trough 25 works in conjunction with an upright, stationary, sheet metal trough 54, which serves to support the foot of the spool 3 in the flat position of the spool receiving trough 25, as shown in FIGS. 2 and 3. In the upright position 25' of the spool receiving trough 25 according to FIG. 3, the sheet metal trough 54 forms a sleeve together with the spool receiving trough 25, which prevents the spool 3 from tripping over from its position 3'.

FIGS. 1 and 2 show especially clearly that a sheet metal guide 55 is disposed below the deflector 51, is inclined from the horizontal plane, is connected with the bracket 16, and leads from the conveyor belt 19 to the edge of the spool receiving trough 25. According to FIG. 2, the sheet metal guide 55 continues into a trough-shaped part 56 which represents a trough-shaped elongation of the spool receiving trough 25, if the spool receiving trough 25 is in the flat position.

After the thread 6 has been completely pulled from the spool 2, or if the thread leaves the observation range of the sensor 9 after a thread break, the sensor 9 responds and gives a signal to a summing device 58 through a functional or operative connection 57. If a spool presence signal simultaneously reaches the summing device 58 through the functional connection 48, the summing device 58 issues a signal which initiates a spool-changing operation through a functional or operative connection 59. In another case, the summing device 58 waits until the spool receiving trough 25 has received a spool. The spool changing cycle is initiated by pushing out a non-illustrated arresting bar through which a splicing or knot-producing carriage is forced to stop at the respective winding station. The knotting or splicing carriage is programmed to mechanically act on the lever mechanism of the winding station, such as the lever configuration 60 according to FIG. 1.

A lever 60' of the lever configuration 60 is pulled in the direction of an arrow 61 which causes the spool receiving trough 25 to be brought into the upright position 25'. The rod 38 is then rotated and returned, causing the slider 36 to be opened for a short time and closed again, with the result that the thread end which is in the spool sleeve is sucked in and then clamped by a slider 36. A rod is simultaneously moved in the direction of an arrow 64, causing an angular lever 65 to be moved and actuating the lever configuration 43, through which the spool releasing device 41 is opened. The spool 3 slides from its position 3' and moves spontaneously downward toward the run-off position 4. The mounting pin 15 has been previously moved to the leading position 15' by swinging the pin about the axis 14, so that the spool slides over the chute 40 directly onto the mounting pin 15, which is then again returned to the run-off position.

The thread 67 of the new spool which is then extended from the suction head orifice 35 to the run-off position 4, is pushed toward the winding station 1 by a thread bringer or deliverer 68. The thread bringer 68 is formed of a lever which can pivot about a pivot point 69. The swinging motion of the thread bringer 68 is effected by a lever configuration 70 in connection with an angular lever 66. The lever configuration 70 is connected to a gear segment 71, which can swing about a pivot point 72, as shown in FIG. 2. The gear segment 71 engages with a gear 73 which is connected to the thread bringer 68.

The above-described apparatus enables the thread bringer 68 to swing in a very wide arc, if a rod 63 is pulled by the above-mentioned travelling splicing or knotting device.

The thread bringer 68 moves the thread 67 far enough so that it comes within the range of a splicing or knotting head 74 of the above-mentioned movable splicing or knotting device, diagrammatically shown in the drawings, which then makes a thread connection, so that a new winding operation can start after the excess thread end has been cut. The excess thread end is sucked into the tube 32 of the thread suction device 31 by operating the rod 38 again.

After the spool has been discharged, the spool presence sensor requests a new spool in the manner described above. The new spool is moved by the deflector 51 from the conveyor belt 19 into the spool receiving trough 25. After this is done, the reserve position 5 is again occupied by a spool.

After the thread connection has been made, the movable splicing or knotting device automatically travels to a new station where it is needed.

We claim:

1. Automatic winding machine, comprising: a multiplicity of winding stations; a conveyor belt guided along said winding stations for supplying individual spools in axial alignment to said winding stations in a given transport direction along a given transport plane; each of said winding stations including: a run-off position and a reserve position in which respective spools are maintained in readiness, a controllable deflector for conducting spools base-first from said conveyor belt to said reserve position, a chute for guiding spools from said reserve position to said run-off position, a spool receiving trough disposed below said given transport plane and substantially parallel to said given transport direction, a controllable thread suction device, and means for shifting said spool receiving trough from a relatively flat position to a relatively upright position in which a tip of a tube of a spool in said spool receiving trough approaches said thread suction device and the spool is aligned on the chute.

2. Automatic winding machine according to claim 1, including a controllable spool releasing device disposed between said spool receiving trough and said chute.

3. Automatic winding machine according to claim 1, wherein said spool receiving trough includes a sensor sensing the presence of a spool, said sensor issuing a spool request signal and a spool receipt signal.

4. Automatic winding machine according to claim 3, wherein said sensor controls said deflector.

5. Automatic winding machine according to claim 3, wherein said spool receiving trough has side walls and said sensor is a reflecting light gate disposed in said side walls.

6. Automatic winding machine according to claim 1, including an upright stationary sheet metal trough serving as a stop for a base of the spool when said spool receiving trough is in said relatively flat position, and forming a sleeve with said spool receiving trough preventing tipping of the spool when said spool receiving trough is in said relatively upright position.

7. Automatic winding machine according to claim 1, wherein said spool receiving trough has an edge, and including a sheet metal guide extending at an incline relative to the horizontal from said conveyor belt to said edge, said sheet metal guide including a trough-shaped part forming an elongation of said spool receiving trough when said spool receiving trough is in said relatively upright position.

* * * * *